US005980004A

United States Patent [19]

Shoenfeld

[11] Patent Number: 5,980,004

[45] Date of Patent: Nov. 9, 1999

[54] DIGITAL VIEWING STATION

[75] Inventor: Norman A. Shoenfeld, Livingston, N.J.

[73] Assignee: S&S X-Ray Products, Inc., Brooklyn, N.Y.

[21] Appl. No.: 09/139,778

[22] Filed: Aug. 25, 1998

[51] Int. Cl.[6] ..... A47B 81/00

[52] U.S. Cl. ..... 312/223.3; 312/195; 312/196; 312/351

[58] Field of Search ..... 312/223.2, 223.3, 312/223.6, 351.7, 195, 196, 281, 350, 351, 351.1; 108/50.01, 50.02

[56] References Cited

U.S. PATENT DOCUMENTS

| | | | |
|---|---|---|---|
| 952,624 | 3/1910 | Mothersill | 312/196 |
| 1,163,868 | 12/1915 | Sherer | 312/351 X |
| 1,990,756 | 2/1935 | Saaf | 312/351 X |
| 3,819,245 | 6/1974 | Tacke et al. | 312/351.7 |
| 4,640,199 | 2/1987 | Zigman | 312/223.3 X |
| 4,712,842 | 12/1987 | Price et al. | 312/196 |
| 4,752,106 | 6/1988 | Shields et al. | 312/223.3 |
| 4,798,423 | 1/1989 | LaCour | 312/195 |
| 4,920,458 | 4/1990 | Jones | 248/917 X |
| 5,044,284 | 9/1991 | Gross | 108/10 |
| 5,118,172 | 6/1992 | Ugalde | 312/208.1 |
| 5,160,188 | 11/1992 | Rorke et al. | 312/196 |
| 5,276,524 | 1/1994 | Inoue et al. | 312/223.2 X |
| 5,419,525 | 5/1995 | Hilton | 248/371 |
| 5,429,431 | 7/1995 | Olson et al. | 312/223.6 |
| 5,568,773 | 10/1996 | Hung | 108/50.01 |
| 5,584,546 | 12/1996 | Gurin et al. | 312/200 |
| 5,607,214 | 3/1997 | Pierce et al. | 312/310 |
| 5,655,822 | 8/1997 | Roberts et al. | 312/195 X |
| 5,678,905 | 10/1997 | Kelley | 312/196 |
| 5,762,409 | 6/1998 | Rice, Jr. | 312/223.2 X |

FOREIGN PATENT DOCUMENTS

| | | | |
|---|---|---|---|
| 626142 | 11/1994 | European Pat. Off. | 312/223.2 |
| 2252241 | 8/1992 | United Kingdom | 312/223.3 |

OTHER PUBLICATIONS

RADX Technology, Desk Top Panoramascope Model 200CD product sheet, 1997.

*Primary Examiner*—Peter M. Cuomo
*Assistant Examiner*—James O. Hansen
*Attorney, Agent, or Firm*—Trapani & Molldrem

[57] ABSTRACT

A digital work station can be used in a radiology lab, with x-ray illuminators on an upper shelf for viewing traditional film x-rays, and computer monitors, e.g., CRTs at a lower shelf for viewing digitized x-rays. The work station is ergonomically arranged for radiologist's viewing comfort and efficiency. The height of the illuminators can be adjusted, and the shelves for the computer monitors can be adjusted also to accomodate the user preference. The monitor shelf can be level or angulated (e.g., 20 degrees) and is adjustable up and down in either orientation. The upper shelf is adjusted to minimize the gap above the monitors, and the front edge of the upper shelf maintains alignment with the sloping edge of the side walls if the upper shelf is elevated or lowered. Power outlets are provided on the front edges of the side walls just above a work shelf. The work shelf can have pull-out writing shelves.

15 Claims, 3 Drawing Sheets

DIGITAL VIEWING STATION

BACKGROUND OF THE INVENTION

This invention relates to a workstation suited for radiology use, and is especially directed to a radiology viewing station for viewing digital soft copy images and for conducting film-based studies at the same workstation. The invention is more specifically directed to a workstation that is ergonometrically designed to improve the radiologist's viewing comfort and efficiency.

At present, where a radiologist works with computerized images, the digital x-ray images are viewed on a video monitor at a console. The console is typically at a fixed height and viewing angle. Also, where the radiologist is working with both traditional film images and digital images, then a lighted illuminator is required, and this is separate from the digital viewing console.

Motorized x-ray viewers are currently the standard method used in busy radiology departments to efficiently read x-ray film. These hold between 50 and 1200 radiographs, and bring selected films into view automatically. These may be stand-alone products, or be designed to fit onto a desktop, such as the Model 200 Desk Top Panoramascope, made by RADX Technology.

Various computer desks and workstations have been proposed to place a computer monitor or other video viewing screen at some optimal level for a person at the workstation. A workstation that is typical of these is discussed in U.S. Pat. No. 5,118,172, which places a monitor behind the keyboard and permits it to rotate independently of the keyboard shelf. Another is shown in U.S. Pat. No. 5,044,284, which purports to place the video display screen and keyboard at minimum fatigue locations. U.S. Pat. No. 4,920,458 discuses an ergonomically adjustable workstation in which there are multiple video display terminals at different vertical levels. However, the top monitor is angled at approximately minus 20 degrees, and this would be entirely inadequate for an illuminator for film viewing, as the film would fall forward away from the illuminator. U.S. Pat. No. 4,725,106 describes a workstation that is reconfigurable, with a large display unit mounted above one or more other visual display units, which can be rotated up or down. None of the previously proposed workstations is suited for use as a radiology workstation for viewing digital radiology image, or for viewing both film images and digital images.

None of the previously-proposed work stations and related furniture have been adapted for working in a radiology laboratory, and the features of the furniture and equipment in the prior patents have not been designed with the needs of the radiologist in mind. There has been no workstation or furniture previously proposed for viewing digitized x-ray images, such as may be produced in digital subtractive angiography (DSA). None of the available work stations have been provided with a means for studying both digital x-ray images and film x-ray images together, and none of the available work station furniture provides for efficiency or comfort of the radiologist.

OBJECTS AND SUMMARY OF THE INVENTION

Accordingly, it is an object of the present invention to provide a digital viewing station for radiology studies that avoids the drawbacks of the prior art.

It is another object to provide a full featured radiologist workstation that can adapt to future innovations.

It is a further object to provide a workstation that incorporates the look and feel of a motorized viewer into a viewing station for soft copy interpretation.

It is still another object to provide a digital viewing station that permits the radiologist to work with digital soft copies and at the same time to review older film-based studies at the same workstation.

It is a yet further object to provide a workstation with a large workdesk, pull-out writing shelves, abundant legroom, and easy access to power outlets for other equipment.

Another object is to provide the advantages of this work station on a relatively small footprint, for efficient utilization of departmental floor space.

In accordance with an aspect of the present invention, a radiology work station is in the form of a desk or cabinet having left and right side walls disposed parallel to one another and extending upwards to a work shelf level, and then continuing above the work shelf level to a top. The front or proximal edges of the left and right side walls are angled back above the work shelf, so that these front edges slope back at an angle, e.g., 20 degrees, from the work shelf level to the top. A work shelf is affixed at the work shelf level between said left and right side walls so that the work shelf projects proximally. A lower shelf that is adapted to support one or more video display monitors is disposed between said side walls distally of the work shelf. There are sockets provided in the side walls and posts or other suitable means in the lower shelf to hold the lower shelf in a selected one of a horizontal orientation and an angulated orientation. In the angulated orientation, the shelf slopes away downward. Also, the lower shelf can be selectively positioned at any of a number of vertical positions in either of the horizontal and angulated orientations. This permits the video viewing devices, i.e., computer monitors, to be positioned for optimal comfort and efficiency, at any of a number of viewing positions vertically, and with the screen either vertical or sloping back, according to the user's preference.

An upper shelf is adapted to support one or more x-ray illuminator devices, or alternatively, additional digital viewing monitors. An x-ray illuminator bank can be incorporated into the upper shelf. The upper shelf is supported between the left and right side walls above said lower shelf. The proximal edge of said upper shelf is positioned substantially in alignment with the slanting proximal edges of the left and right side walls. There are means, such as sockets or mounting holes in the side walls and posts in the upper shelf, permitting the upper shelf to be selectively positioned at any of a number of vertical positions. In each of these vertical positions the proximal edge of said upper shelf is in the same alignment with the proximal edges of said the side walls. This feature permits the upper shelf to be positioned as close as possible to the top of the digital monitor(s), and also keeps the front of the upper shelf fully forward regardless of its vertical position. This permits optimal positioning of the x-ray illuminators (or other equipment) that may be supported on the upper shelf.

In a preferred embodiment, there is a first set of mounting holes in the side walls aligned vertically for holding the lower shelf at a selected vertical position at the horizontal orientation, and post means projecting from the shelf into selected holes of the first set of holes. To hold the lower shelf in a selected angulated orientation there is a second set of mounting holes in the side walls, the holes being aligned at an angle with respect to vertical. Preferably, in the angulated orientation, the shelf is sloped back approximately 20 degrees below horizontal.

Also in the preferred embodiment, the proximal edges of the left and right side walls are angled back at a slope angle of approximately 20 degrees.

The work station can have leveling feet at the bottoms of the side walls for adjusting the vertical height of the work station. Alternatively, casters can be provided at the bottom of the side walls to permit the work station to be rolled from one location to another.

There can be any number of viewing sections incorporated into the x-ray illuminator affixed onto an upper surface of the upper shelf, and in a preferred mode there is a four-section x-ray illuminator. The radiology work station can have a hinged front bottom cover below the work shelf and between said left and right side walls, to cover any equipment that may be on a bottom shelf in the work station. The cover is hinged to open for easy access. This may also serve as a modesty panel. There can also be slide-out writing shelves on the work shelf.

The digital viewing station may be constructed to hold two computer monitors on the lower shelf, and a four-bank illuminator on the top shelf. Alternatively, the viewing station may accommodate three monitors, or four monitors, with the upper shelf holding a larger, multi-bank x-ray illuminator. The digital viewing station may also be provided as a corner module, accommodating only a single computer monitor on the lower shelf and a single-bank illuminator on the upper shelf.

In a preferred mode, auxiliary electrical outlets are disposed in the proximal edge of one or both side walls, preferably just above the work shelf level. The side walls may be hollow to accommodate and conceal computer cabling and electrical and communications wiring.

The above and many other objects, features, and advantages of this invention will become apparent from the ensuing description of a selected preferred embodiment, which is to be considered in connection with the accompanying Drawing.

Figure 1:
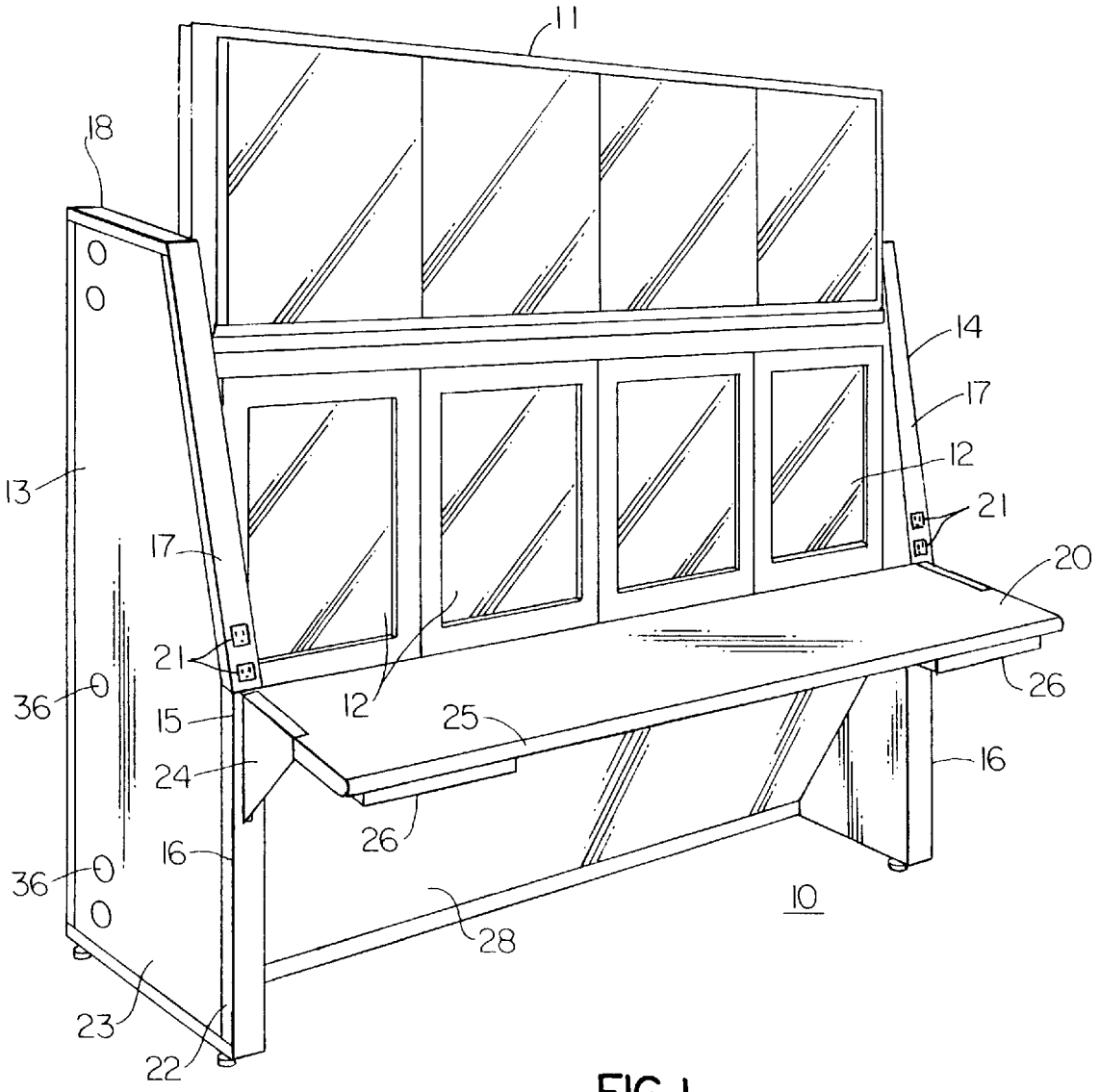
FIG. 1 is a perspective view of a digital workstation according to one preferred embodiment of the invention.
Figure 2:
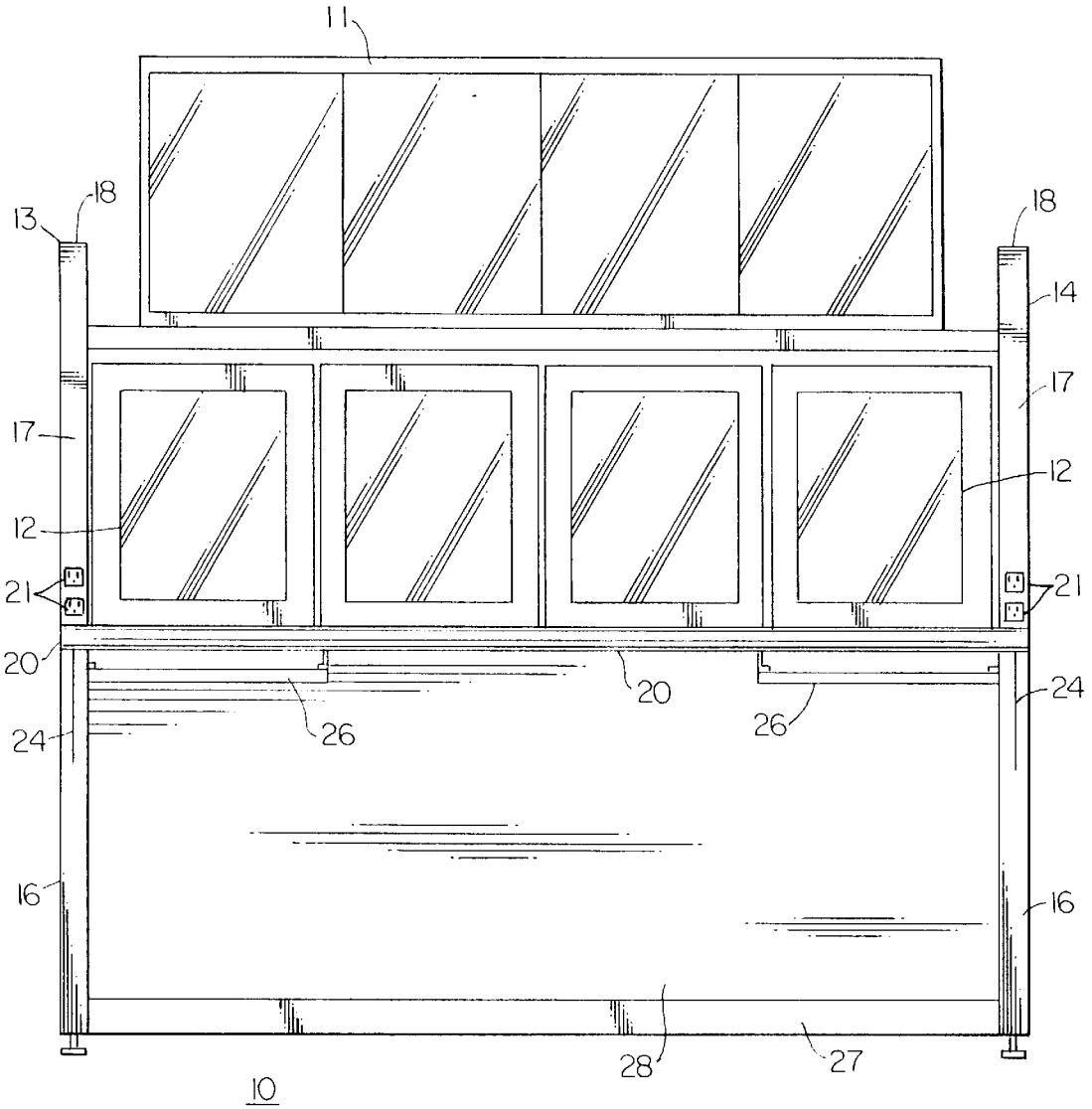
FIG. 2 is a front elevation of this embodiment.

DETAILED DESCRIPTION OF THE PREFERRED EMBODIMENT with reference to the Drawing, and initially to FIGS. 1 and 2, a radiology work station 10 is configured to hold a four-section x-ray illuminator 11, positioned at its top, and a number of computer CRTs or similar monitors 12, positioned below, for soft-copy reading of x-ray studies. These work stations can be used to accommodate other medical imaging as well, e.g., ultrasonic images, magnetic resonance images, or other examples. The work station 10 is in the form of a desk or similar furniture with vertical left and right wall members 13 and 14, that define the left and right sides of the station, and extend vertically and parallel to one another. These have front or proximal edges 15 that are generally vertical from the floor up to a work shelf level 16, and then have a slanted portion 17 extends back and up at an angle of about twenty degrees, for example, to a top level 18. A work shelf 20 is supported between the two side wall members 13, 14, and in this example is cantilevered, extending horizontally and proximally from the side wall members. In each of the slanted edge portions 17, just above the work shelf 20, there are electrical utility outlets 21 for powering dictation equipment, brightspot illuminators, laptop computers, or other ancillary equipment.

Figure 3:
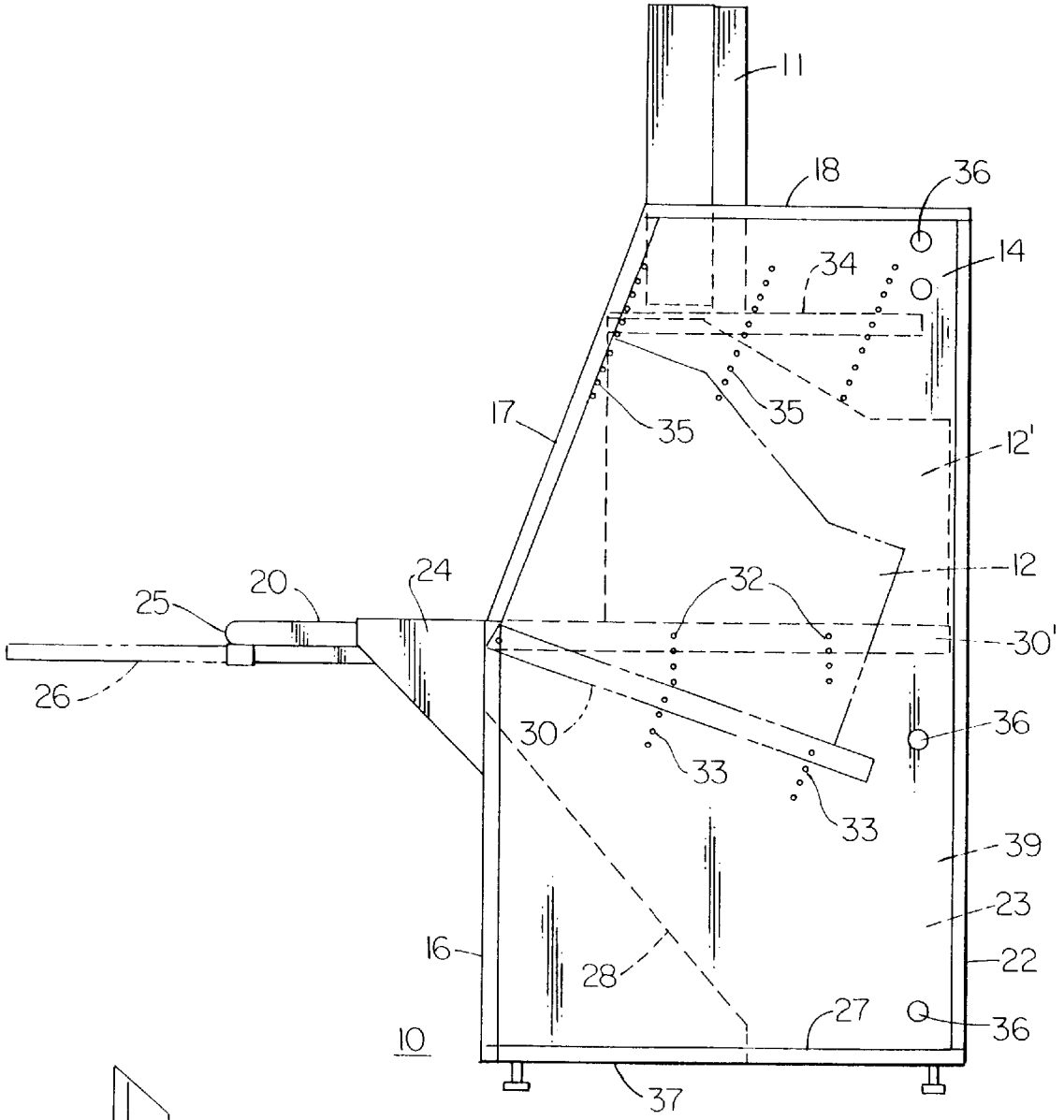
FIG. 3 is a side elevation of this embodiment showing the lower shelf and monitor in an angulated orientation (in solid and chain line) and showing the lower shelf and monitor in a horizontal orientation (in broken line).

As shown in FIG. 3, the wall members 13 and 14 each comprise a frame 22 and a removable side cover 23 that fits into the frame 22 at the side and conceals wiring, cabling, and hardware. There may be surge protection equipment or other electrical devices concealed in the side wall members as well.

The work shelf 20 is supported on a pair of brackets 24, 24, each attached at the workshelf level to a respective one of the side wall members. Here the work shelf 20 has a bull-nose front edge 25 and a Formica top covering. Beneath the shelf 20 are two pull-out writing shelves 26, 26, one on each side (shown extended in FIG. 3).

A bottom support 27 extends across the base between the side wall members, and can hold computer equipment. This support 27 is recessed from the front or proximal edge of station, and provides ample leg room for the radiologist. A cover 28 is hinged to swing out for access to the area above the support 27.

A lower shelf 30 provides a support surface for one or more computer monitors 12, and can position the monitors 12 at either zero degrees angulation or twenty degrees angulation. The shelf 30' and monitor 12' are shown in broken line at the zero-degree orientation. The slanted edge portions 17 of the side walls are also at twenty degrees in this embodiment to match the angulation of the monitors. Here there is a first set of mounting holes 32, arranged in vertical rows in each of the side walls, for mounting the lower shelf 30 at any of a number of vertical positions in the horizontal or zero-degree orientation. There is also a second set of mounting holes 33 arranged at a twenty degree angle, for mounting the shelf at any of a number of vertical positions at the angulated orientation. While not shown here, there are mounting devices that extend from the side edges of the shelf 30 into these holes for supporting the shelf at the selected position and orientation. These can be pegs, bolts, or other known means.

An upper shelf 34 is situated above the computer monitors 12 between the two side walls, and can be positioned so as to minimize the space between the top of the monitors and the shelf 34. The shelf 34 is positioned with its front edge in near alignment with the forward or proximal slanted edge portions 17 of the side walls. In this embodiment, there are mounting holes 35 arranged at a twenty degree angle from the vertical for mounting the shelf 34. This ensures that the front edge of the shelf 34 is aligned with the proximal edge portions 17 in each of the possible selected vertical positions. Again, the shelf 34 is mounted in the holes 35 using known means, such as pegs, studs, or bolts. The upper shelf 34 can be adjusted to be close to the top of the monitors 12 with a minimal spacing gap, when the monitors are either in the zero or angulated orientation, and so that the front of the top shelf is always at the front edge of the angulated side edge.

Figure 4:
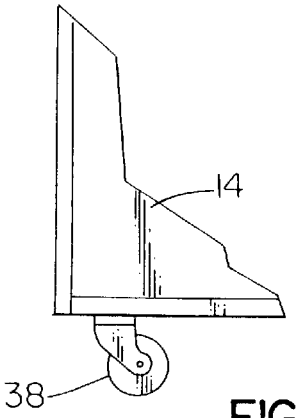
FIG. 4 is partial view showing a caster mounting.

In addition, in this embodiment there are access holes 36 in the side walls for wiring and cabling, and there are leveling legs 37 at the base of the side walls 13, 14 for height adjustment and to level the work station in the event that the floorspace is out of level. Alternatively, there can be casters 38 (FIG. 4) to permit the work station to be rolled into place.

Modesty panels 39 are provided at the back or distal side of the work station.

In alternative arrangements, the angulation can be some angle other than twenty degrees, and if desired there can be means for orienting the lower and upper shelves at any of three or more angular orientations. Also, while this embodiment accommodates four computer monitors and a four-bank illuminator, the viewing station or work station could accommodate more or fewer computer monitors, and illuminators with more or fewer viewing sections. Also, the top shelf can be adapted to fit a motorized viewer, or can hold additional computer monitors or peripherals.

While the invention has been described hereinabove with reference to a preferred embodiment, it should be recognized that the invention is not limited to that precise embodiment. Rather, many modification and variations would present themselves to persons skilled in the art without departing from the scope and spirit of this invention, as defined in the appended claims.

I claim:

1. Radiology work station comprising:

(a) left and right side walls disposed parallel to one another and extending upwards to a work shelf level and above said work shelf level to a top, said left and right sidewalls each having a proximal edge and a distal portion, said proximal edges being angled toward said distal portion at a slope angle from said workshelf level to said top;

(b) a workshelf affixed at said workshelf level between said left and right side walls and projecting proximally therefrom;

(c) a lower shelf adapted to support one or more video display monitors and disposed between said side walls distally of said workshelf, including means to hold said lower shelf in a selected one of a horizontal orientation and an angulated orientation which is sloping back relative to said horizontal orientation, and permitting the lower shelf to be selectively positioned at any of a plurality of vertical positions in either of said horizontal orientation and said angulated orientation; and (d) an upper shelf adapted to support one or more x-ray illuminator devices and supported between said left and right side walls above said lower shelf with a proximal edge of said upper shelf disposed in alignment with the proximal edges of said left and right side walls, including means permitting the upper shelf to be selectively positioned at any of a plurality of vertical positions, such that in each of said vertical positions the proximal edge of said upper shelf is in said alignment with the proximal edges of said side walls.

2. The radiology work station of claim 1 wherein said means to hold said lower shelf in a selected horizontal orientation includes a first set of holes in said side walls aligned vertically for holding said lower shelf at a selected vertical position at said horizontal orientations, and post means projecting from said shelf into selected holes of said first set of holes.

3. The radiology work station of claim 2, wherein said means to hold said lower shelf in a selected angulated orientation includes a second set of holes in said side walls aligned at an angle with respect to vertical.

4. The radiology work station of claim 1 wherein said angulated orientation is sloped back approximately 20 degrees below horizontal.

5. The radiology work station of claim 4 wherein said proximal edges of said left and right sidewalls are angled back at a slope angle of approximately 20 degrees.

6. The radiology work station of claim 1, wherein said side walls have bottoms, and further comprising adjustable leveling feet at the bottoms of said side walls.

7. The radiology work station of claim 1, wherein said side walls have bottoms, and further comprising casters at the bottoms of said side walls to permit the work station to be rolled from one location to another.

8. The radiology work station of claim 1, comprising a plurality of x-ray illuminators affixed onto an upper surface of said upper shelf.

9. The radiology work station of claim 1, comprising a plurality of x-ray illuminators incorporated into said upper shelf.

10. The radiology work station of claim 1, wherein said side walls have bottoms, and said proximal edges of said side walls proceed vertically from said bottoms up to said shelf level, and then proceed at said slope angle to said top.

11. The radiology work station of claim 1, further comprising a hinged front bottom cover below said work shelf and between said left and right side walls.

12. The radiology work station of claim 1, further comprising a pull-out writing shelf slidably suspended beneath said work shelf.

13. The radiology work station of claim 1, further comprising an electrical outlet disposed in the proximal edge of at least one of said left and right side walls.

14. The radiology work station of claim 1, wherein said upper and lower shelves have distal sides that are disposed at least somewhat forward of distal sides of said left and right side walls, so as to leave room to accommodate cabling and wiring behind the shelves.

15. The radiology work station of claim 1, wherein left and right side walls include wire and cable channel means therein for concealing cables and wires from view.

* * * * *